US009701907B2

(12) United States Patent
Dohi et al.

(10) Patent No.: US 9,701,907 B2
(45) Date of Patent: Jul. 11, 2017

(54) COKE MANUFACTURING METHOD

(71) Applicant: JFE STEEL CORPORATION, Tokyo (JP)

(72) Inventors: Yusuke Dohi, Tokyo (JP); Kiyoshi Fukada, Tokyo (JP); Takashi Matsui, Tokyo (JP); Michio Honma, Tokyo (JP); Masahiro Shinohara, Tokyo (JP); Mikiya Nagayama, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 7 days.

(21) Appl. No.: 14/646,514

(22) PCT Filed: Nov. 13, 2013

(86) PCT No.: PCT/JP2013/080652
§ 371 (c)(1),
(2) Date: May 21, 2015

(87) PCT Pub. No.: WO2014/080817
PCT Pub. Date: May 30, 2014

(65) Prior Publication Data

US 2015/0307785 A1 Oct. 29, 2015

(30) Foreign Application Priority Data

Nov. 22, 2012 (JP) ..... 2012-256533

(51) Int. Cl.
*C10B 53/04* (2006.01)
*C10B 57/04* (2006.01)
*C10B 47/04* (2006.01)

(52) U.S. Cl.
CPC ..... *C10B 53/04* (2013.01); *C10B 47/04* (2013.01)

(58) Field of Classification Search
USPC ..... 44/607
See application file for complete search history.

(56) References Cited

FOREIGN PATENT DOCUMENTS

| | | | |
|---|---|---|---|
| CN | 2828050 | Y | 10/2006 |
| CN | 101531908 | A | 9/2009 |
| CN | 101699266 | A | 4/2010 |
| CN | 101701159 | A | 5/2010 |
| CN | 101706406 | A | 5/2010 |
| JP | H02-167394 | A | 6/1990 |
| JP | H06-330052 | A | 11/1994 |
| JP | 2007-077254 | A | 3/2007 |
| JP | 2007-112941 | A | 5/2007 |
| JP | 3985605 | B2 | 10/2007 |
| JP | 4830370 | B2 | 12/2011 |
| JP | 4899390 | B2 | 3/2012 |

OTHER PUBLICATIONS

May 20, 2016 Office Action issued in Korean Patent Application No. 2015-7013208.
May 24, 2016 Extended Search Report issued in European Patent Application No. 13856794.6.
Sundholm, J.L. et al. "Chapter 7: Manufacture of Metallurgical Coke and Recovery of Coal Chemicals," The AISE Steel Foundation, pp. 381-546, 1999.
Sakawa et al., "Coal and Coke," the Iron and Steel Institute of Japan, (2002).
Okoshi et al., "Coke Circular," vol. 20, (1971), pp. 271-277.
Yamamoto et al., "Effect of coking conditions on clearance between coke oven wall and coke cake," Current Advances in Materials and Processes, vol. 20, (2007), pp. 876.
Arima, Takashi, "The Effect of Defects on Surface-breakage Strength of Coke," Tetsu-to-Hagané, vol. 87, (2001), pp. 274-281.
Kubota et al., "Effect of Inert Size on Coke Strength," Iron and Steel, vol. 92, No. 12, (2006), pp. 833-840.
Uebo et al., "Evaluation of coke strength by hardness measurement," Current Advances in Materials and Processes, vol. 17, (2004), pp. 618-621.
Satoh et al., "An Evaluation of the Mixing Characteristics of Solid Mixers Using Adhesive Fine Powders," Powder Technology Journal, vol. 30, No. 6, (1993), pp. 390-396.
Feb. 18, 2014 Search Report issued in International Patent Application No. PCT/JP2013/080652.
Jan. 22, 2015 Office Action issued in Taiwanese Patent Application No. 102142330.
Jan. 10, 2017 Office Action issued in Chinese Patent Application No. 201380059662.X.
May 4, 2016 Office Action issued in Chinese Patent Application No. 201380059662.X.
Jun. 14, 2016 Office Action issued in Japanese Patent Application No. 2015-108140.

*Primary Examiner* — Randy Boyer
*Assistant Examiner* — Chantel Graham
(74) *Attorney, Agent, or Firm* — Oliff PLC

(57) ABSTRACT

A coke manufacturing method includes preparing blended coal by blending coal of at least two types, stirring and mixing the blended coal so as to disintegrate at least a part of pseudo-particles in the blended coal that have been formed by agglomeration of coal particles, and charging the blended coal after stirring and mixing into a coke oven and carbonizing the blended coal so as to manufacture coke.

9 Claims, 7 Drawing Sheets

COKE MANUFACTURING METHOD

FIELD

The present invention relates to a coke manufacturing method for manufacturing coke by charging blended coal into a coke oven and carbonizing the blended coal.

BACKGROUND

In general, various operational troubles occur with the aging of a coke oven. Among such operational troubles, "sticker", which can hamper the discharge of manufactured coke from the oven, is an extremely serious operational trouble. When "sticker" occurs, a manufacturing schedule of coke is forced to be changed and a manufacturing amount of coke is thus decreased. In addition, the occurrence of "sticker" causes damage to an oven body, resulting in a short lifetime of the coke oven.

The general mechanism of "sticker" is as follows. In operation of general chamber-type coke ovens, blended coal charged into a carbonization chamber is sequentially carbonized from the oven wall side with heat coming from a combustion chamber adjacent to the carbonization chamber and a cake of coke is generated. In normal operation, the cake of coke itself shrinks by carbonization, and spaces (hereinafter, referred to as clearance) are formed between oven walls and the outer surfaces of the cake of coke. The formation of the clearance enables the cake of coke to be discharged (extruded) to the outside of the oven easily.

When clearance having a sufficient size is not formed due to insufficient shrinkage of the cake of coke, "sticker" occurs because of increased frictional resistance between the oven walls and the outer surfaces of the cake of coke in discharging the cake of coke. Furthermore, when the surfaces of the oven walls have large irregularities, "sticker" occurs because of increased frictional resistance between the oven walls and the outer surfaces of the cake of coke in the same manner.

The irregularities on the surfaces of the oven walls increase under influence of abrasion and drop of bricks of the oven walls, growth of carbon attached to the oven walls, and the like with advancement of deterioration of an old coke oven. That is, the occurrence frequency of "sticker" inevitably increases with the aging of the coke oven. In consideration of these circumstances, various measures have been taken to reduce the occurrence frequency of "sticker" in operation of the old coke oven.

As a measure to reduce the occurrence frequency of "sticker", a wet coal operation, in which the coke oven is operated without actively decreasing the moisture content of blended coal from the moisture content (approximately 8 to 14% by mass although it fluctuates depending on the season and the weather) of the blended coal when it has been piled up in a yard, has been widely employed as the simplest and the most effective means. An increase in the moisture content of the blended coal lowers the charging bulk density of the blended coal and enlarges the clearance, for example, and thus the frictional resistance between the oven walls and the outer surfaces of the cake of coke in discharge is decreased, thereby reducing the occurrence frequency of "sticker".

To be specific, Patent Literature 1 discloses a technique of carbonizing blended coal in a coke oven after the moisture content of the blended coal is adjusted using a coal moisture-control facility. The technique involves calculation of a target moisture content of the blended coal that is necessary for ensuring a desired clearance based on a relation between the moisture content of the blended coal and the clearance previously measured. With this technique, heat input into the coal moisture-control facility is controlled such that the total moisture content of the blended coal at the output side of the coal moisture-control facility will become the target moisture content, thereby reducing the occurrence frequency of "sticker".

Furthermore, Patent Literature 2 discloses a technique by which water is locally added to coal in a coal tower for supplying the coal to a coal charging car that charges the coal into a carbonization chamber and the coal to which water is added is charged into the carbonization chamber through the coal charging car. With this technique, the coal having an increased moisture content relative to other coal is unevenly distributed into a part of the carbonization chamber, and thus the shrinkage rate of the coke on coal portions having the increased moisture content is increased and the clearance is enlarged, thereby reducing the occurrence frequency of "sticker".

As described above, the increase in the moisture content of the blended coal is effective in reducing the occurrence frequency of "sticker". Note that many coke ovens introduce a process of decreasing the moisture content of the blended coal using a moisture control facility or preheating facility into a pretreatment process of the blended coal in order to improve coke strength, for example. The reduction in the occurrence frequency of "sticker" is, however, the most important matter for operation with the old coke oven.

For this reason, the moisture content of the blended coal cannot be decreased even when improvement in the coke strength is required, and the moisture content of the blended coal tends to be increased. Gas permeability and liquid permeability need to be ensured in a blast furnace for stably operating the blast furnace using coke manufactured in a coke oven, and coke that has excellent strength, in particular, drum strength, which is measured by the drum strength test method according to JIS K 2151, is essential. In view of these circumstances, techniques of improving the strength of coke have been developed.

The techniques of improving the coke strength are largely classified into a pretreatment technique, a blending technique, and a carbonizing technique. Among them, the pretreatment technique enables a facility to be designed so as not to impose restriction on productivity of a coke oven without increasing the cost of blended coal, and is thus considered to be particularly important. The pretreatment technique is largely classified, based on the way of approach to the coke strength, into two techniques: (1) a technique of improving the charging bulk density of the blended coal (hereinafter, referred to as technique (1)) and (2) a technique of homogenizing the blended coal (hereinafter, referred to as technique (2)).

An object of the technique (1) is to reduce spaces between coal particles when the blended coal is charged into the coke oven in order to reduce the number of pore defects, which can influence the coke strength. Methods of the technique (1) include: a method by which the blended coal is mechanically consolidated and is charged into the coke oven, examples thereof include a method by which some coal briquette is charged and a stamping method; and a method of improving the charging bulk density by decreasing the moisture content of the blended coal and making attachment force between the coal particles weak, examples thereof include a coal moisture control method, preheated coal charging, the dry-cleaned and agglomerated precompaction system (DAPS), and the super coke oven for productivity and environmental enhancement toward the 21st century (SCOPE-21) (see Non-Patent Literature 1).

By contrast, an object of the technique (2) is to raise the strength of a portion of the coke that has the lowest strength. The coal is originally composed of textures having different thermal and mechanical characteristics and is extremely non-homogeneous, and the texture of coke manufactured from the non-homogeneous coal is also non-homogeneous. The strength of a brittle material such as coke is generally described based on a weakest link model, and is determined by the strength of the portion having the lowest strength in the material. Accordingly, homogenization of the texture of the coke can average the strength in the coke, thereby raising the strength of the portion of the coke that has the lowest strength and improving the strength of the entire coke.

Methods of the technique (2) include a method by which the particle size of coal is adjusted (see Non-Patent Literature 1). The method by which the particle size of the coal is adjusted basically aims at homogenization of the texture of the coke by finely grinding the coal. Also known is a method of homogenizing the texture of coke by processing coal with a coal mixer such as a drum mixer and enhancing the mixing degree of the coal (see Non-Patent Literature 2). Meanwhile, conventional studies have revealed that blended coal to be used in a coke manufacturing process is sufficiently mixed by connection of belt conveyors during conveyance, for example, without passing through a coal mixer (see Non-Patent Literature 2). For this reason, many coke plants have taken measures to homogenize the texture of coke without using coal mixers.

CITATION LIST

Patent Literature

Patent Literature 1: Japanese Patent No. 3985605

Patent Literature 2: Japanese Patent No. 4830370 Non-Patent Literature

Non-Patent Literature 1: Sakawa et al., "Coal and Coke", 2002, the Iron and Steel Institute of Japan, Tokyo Non-Patent Literature 2: Okoshi et al., "Coke Circular", Volume 20, 1971, p. 271

Non-Patent Literature 3: Yamamoto et al., "Current Advances in Materials and Processes", Volume 20, 2007, p. 876

Non-Patent Literature 4: Takashi Arima, "Tetsu-to-Hagene", Volume 87, 2001, p. 274

Non-Patent Literature 5: Kubota et al., "Iron and Steel", Volume 92, 2006, p. 833

Non-Patent Literature 6: Uebo et al., "Current Advances in Materials and Processes", Volume 17, 2004, p. 618

Non-Patent Literature 7: Sato et al., "Powder Technology Journal", Volume 30, 1993, p. 390

The techniques disclosed in Patent Literature 1 and Patent Literature 2 and the techniques (1) and (2) have the following problems.

The technique disclosed in Patent Literature 1 controls the clearance by controlling the moisture content of the blended coal while the clearance necessary for preventing the occurrence of "sticker" is set to a target value. The technique disclosed in Patent Literature 1 is, therefore, effective in preventing the occurrence of "sticker" but fails to prevent the coke strength from lowering. Likewise, the technique disclosed in Patent Literature 2 controls the clearance by controlling the moisture content of the blended coal and fails to prevent the coke strength from lowering. By contrast, the technique (1) is effective in improving the coke strength but fails to prevent the occurrence of "sticker" because the clearance is made smaller. Actually, the decrease in the moisture content of the blended coal in a deteriorated oven that has been used for over 40 years causes frequent "sticker", so that the coke oven cannot be stably operated. To avoid this situation, the coke oven is operated while keeping the moisture content of the blended coal at a high level even at the expense of the coke strength.

The technique (2) is effective in not only improving the coke strength but also ensuring the clearance (see Non-Patent Literature 3). In a state where the moisture content of the blended coal is high, however, even when the blended coal is grinded to decrease particle diameters, the coal particles agglomerate through water and form pseudo-particles. The formation of the pseudo-particles increases the particle diameters and the effect of the homogenization by grinding is reduced accordingly. The behaviors of the pseudo-particles in the blended coal and influence on the coke strength by the pseudo-particles have not been figured out sufficiently. For this reason, the type of the pseudo-particles to be broken, the degree of breakage of the pseudo-particles, and a preferable method for breaking the pseudo-particles that are appropriate for improving the effect of the homogenization have not been made obvious. In the technique (2), the blended coal is mixed using a coal mixer mainly for convective mixing, such as a drum mixer, so that the coal particles can be mixed macroscopically while keeping a state of the pseudo-particles formed. Accordingly, with the technique (2), the blended coal is mixed while being non-homogeneous microscopically and the strength in the coke cannot be averaged.

SUMMARY

Technical Problem

The present invention has been made in view of the above-mentioned circumstances and an object thereof is to provide a coke manufacturing method capable of manufacturing coke having increased strength and excellent discharging property from a coke oven.

Solution to Problem

The inventors of the present invention have earnestly studied the degree of order of blended coal the homogeneity of which influences coke strength. Consequently, the inventors of the present invention have found that the homogeneity of the blended coal of millimeter order will highly possibly influence the coke strength. The expression of the "homogeneity of the blended coal of millimeter order" means that the homogeneity of the blended coal is high as long as all portions of the blended coal in a range of a regular hexahedron each side of which is several millimeters long, for example, have the same property when the regular hexahedron is focused.

In a state where coal particles of a plurality of types are sufficiently mixed, the homogeneity of the blended coal is high, whereas in a state where the coal particles of a plurality of types are unevenly distributed, the homogeneity of the blended coal is low. For example, when a large number of coal particles each having a particle diameter of several millimeters are present in blended coal, it is said that the coal particles of a plurality of types are not sufficiently mixed on particle portions thereof, and the homogeneity of the blended coal is low. Also when fine coal particles form pseudo-particles each having a particle diameter of several millimeters, the homogeneity of the blended coal is low unless the coal particles of a plurality of types in the pseudo-particles are sufficiently mixed.

Conventionally, influence of the size of coal particles on the coke strength has attracted attention. The inventors of the present invention have revealed that pseudo-particles formed by agglomeration of a plurality of coal particles also influence the coke strength. Moreover, the inventors of the present invention have investigated a relation between the moisture content of blended coal and a formation condition of the pseudo-particles. As a result of the investigation, the inventors of the present invention have found that when the moisture content of the blended coal exceeds 6 [% by mass], a weight ratio of the pseudo-particles having a particle diameter of equal to or larger than 1 [mm] is increased and the homogeneity of the blended coal of the millimeter order is lowered.

The inventors of the present invention have figured out that not only the lowering of the charging bulk density of the blended coal but also the lowering of the homogeneity of the blended coal of the millimeter order with an increase in the weight ratio of the pseudo-particles contributes to the lowering of the coke strength with the increase in the moisture content of the blended coal.

A coke manufacturing method according to the present invention achieved in view of the above-described findings includes: preparing blended coal by blending coal of at least two types; stirring and mixing the blended coal to disintegrate at least a part of pseudo-particles in the blended coal that have been formed by agglomeration of coal particles; and charging the blended coal after stirring and mixing into a coke oven and carbonizing the blended coal to manufacture coke.

Moreover, in the above-described coke manufacturing method according to the present invention, the preparing comprises grinding the coal of at least two types before blending the coal of at least two types.

Moreover, in the above-described coke manufacturing method according to the present invention, the preparing comprises drying the coal of at least two types.

Moreover, in the above-described coke manufacturing method according to the present invention, the stirring and mixing is performed on blended coal having a moisture content of not less than 6% by mass.

Moreover, in the above-described coke manufacturing method according to the present invention, the stirring and mixing comprises stirring and mixing the blended coal using a mixing device having stirring and mixing performance with which an attainment level calculated from the following equation (1) becomes not less than 0.6 after sixty seconds has passed from start of a stirring and mixing operation:

$$\text{Attainment Level}=(V_{max}-V(t))/(V_{max}-V_{st}) \quad (1)$$

where the attainment level is a value calculated from brightness of mixture formed by putting 95% by mass of calcium carbonate having an average particle diameter of 2.66 μm and 5% by mass of iron(III) oxide having an average particle diameter of 0.47 μm into the mixing device and performing the stirring and mixing operation, t indicates an elapsed time from the start of the stirring and mixing operation, $V_{max}$ indicates brightness of calcium carbonate, $V_{st}$ indicates brightness of the mixture in which calcium carbonate and iron(III) oxide are totally mixed, and V(t) indicates brightness of the mixture at time t in the equation (1).

Moreover, in the above-described coke manufacturing method according to the present invention, the stirring and mixing comprises stirring and mixing the blended coal using a mixing device that requires power per unit mixing volume of not less than $1.0\times10^4$ W/m$^3$.

Advantageous Effects of Invention

The coke manufacturing method according to the present invention can manufacture coke having increased strength and excellent discharging property from a coke oven.

DESCRIPTION OF EMBODIMENTS

Figure 1:
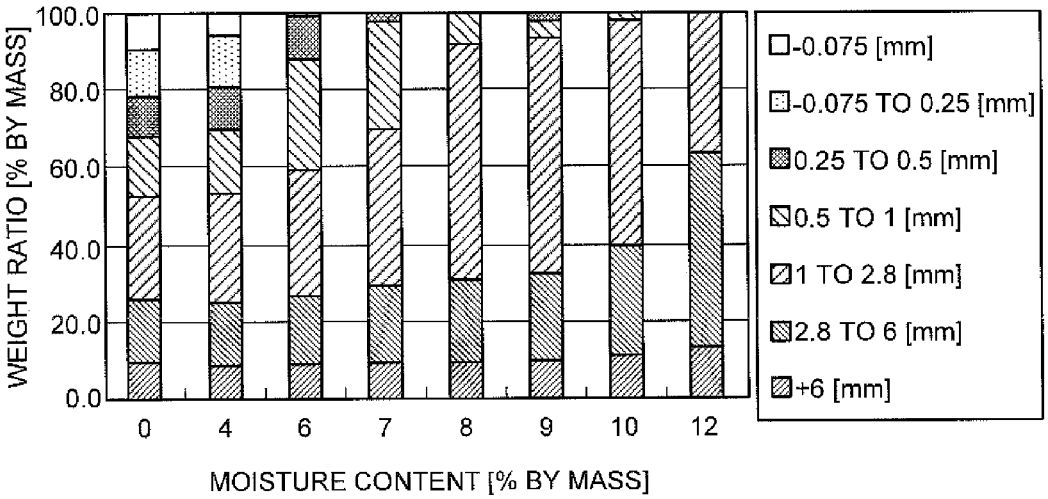
FIG. 1 is a graph illustrating a relationship between the moisture content of blended coal and particle size distribution.

The inventors of the present invention have earnestly studied the degree of order of blended coal the homogeneity of which influences coke strength and have found that the homogeneity of the blended coal of millimeter order will highly possibly influence the coke strength. Furthermore, the inventors of the present invention have found that when the moisture content of the blended coal exceeds 6 [% by mass], a weight ratio of pseudo-particles having a particle diameter of equal to or larger than 1 [mm] is increased and the homogeneity of the blended coal of the millimeter order lowers.

Based on the above-mentioned findings, the inventors of the present invention have concluded that the coke strength of blended coal can be improved by performing a stirring and mixing operation capable of increasing the homogeneity of the blended coal of the millimeter order on the blended coal and have completed the present invention. Hereinafter, an examination flow to arrival at the present invention will be described in detail, and then, a coke manufacturing method as an embodiment of the present invention will be described.

Relations Between Homogeneity of Blended Coal and Coke Strength and Clearance

The inventors of the present invention investigated a relation between the moisture content of blended coal and a formation condition of pseudo-particles. Blended coal having common characteristics for manufacturing metallurgical coke was used as the blended coal. Characteristics (mean maximum reflectance $R_o$[%], Gieseler fluidity log MF [log ddpm], volatile matter VM [% by mass], ash Ash [% by mass]) and a blending ratio [% by mass] of single coal of four types (A to D) composing the blended coal, and mean characteristics of the blended coal are indicated in the following tables 1 and 2, respectively. The mean maximum reflectance was measured in accordance with JIS M8816, the Gieseler maximum fluidity was measured in accordance with JIS M8801, and the volatile matter and the ash were measured in accordance with JIS M8812. The volatile matter and the ash are values based on dried weights.

TABLE 1

| Coal | Ro [%] | logMF [log ddpm] | VM [% by mass] | Ash [% by mass] | Blending ratio [%] |
|---|---|---|---|---|---|
| Coal A | 1.21 | 1.20 | 22.2 | 7.1 | 25 |
| Coal B | 0.89 | 2.79 | 29.3 | 8.5 | 45 |
| Coal C | 0.96 | 2.85 | 27.4 | 9.6 | 20 |
| Coal D | 0.92 | 3.97 | 35.5 | 7.0 | 10 |

TABLE 2

| | |
|---|---|
| Weighted average Ro [%] | 0.99 |
| Weighted average log MF [log ddpm] | 2.52 |
| Weighted average VM [% by mass] | 27.8 |
| Weighted average Ash [% by mass] | 8.2 |

The blended coal was grinded and prepared into particle size distribution (equal to or smaller than 3 [mm]: 75[%], 3 to 6 [mm]: 15[%], equal to or larger than 6 [mm]: 10[%] (% by mass based on a dry weight)) supposing actual operation. The blended coal was heated to 107 [° C.] and the moisture content thereof was set to 0 [% by mass]. Thereafter, water was added to the blended coal and the blended coal was settled for a day and night so as to prepare blended coal having moisture contents (0, 4, 6, 7, 8, 9, 10, and 12 [% by mass]) of eight patterns as indicated in the following Table 3. After that, each blended coal was sieved by a sieving oscillator for five minutes and the particle size distribution thereof was measured.

In typical measurement of the particle size distribution of the blended coal, a sample is dried and pseudo-particles are broken, and then, sieving analysis is performed. Unlike this measurement manner, in this experiment, pseudo-particles generated after the addition of water were sieved while applying constant impact to them for a certain period of time and the particle size distribution of the pseudo-particles that were not broken by the impact was measured. Table 3 indicates measurement results of the particle size distribution. FIG. 1 illustrates the relationship between the moisture content of the blended coal and the particle size distribution.

As illustrated in Table 3 and FIG. 1, when the moisture content of the blended coal was equal to or lower than 4 [% by mass], the particle size distribution was not largely changed from initial particle size distribution (with a moisture content of 0 [% by mass]) and the formation of pseudo-particles with an increased weight ratio of particles having a large diameter was hardly observed. The weight ratio of the pseudo-particles having a particle diameter of equal to or larger than 1 [mm] particularly was significantly increased when the moisture content of the blended coal was around or higher than 6 [% by mass] and advancement of formation of the pseudo-particles was observed.

TABLE 3

| Moisture content [% by mass] | Particle size-based weight ratio [% by mass] | | | | | | |
|---|---|---|---|---|---|---|---|
| | +6 [mm] | 2.8 to 6 [mm] | 1 to 2.8 [mm] | 0.5 to 1 [mm] | 0.25 to 0.5 [mm] | 0.075 to 0.25 [mm] | −0.075 [mm] |
| 0 | 9.9 | 16.4 | 26.6 | 15.2 | 10.1 | 12.6 | 9.2 |
| 4 | 9.0 | 16.5 | 28.2 | 16.9 | 10.6 | 13.1 | 5.7 |
| 6 | 9.3 | 18.1 | 32.4 | 28.5 | 11.3 | 0.6 | 0.0 |
| 7 | 9.6 | 20.1 | 40.3 | 27.8 | 2.1 | 0.1 | 0.0 |
| 8 | 9.7 | 21.9 | 60.4 | 8.0 | 0.0 | 0.0 | 0.0 |
| 9 | 10.4 | 23.0 | 60.1 | 5.0 | 0.0 | 1.5 | 0.0 |
| 10 | 11.6 | 28.5 | 58.1 | 1.7 | 0.0 | 0.0 | 0.0 |
| 12 | 13.7 | 50.3 | 36.0 | 0.0 | 0.0 | 0.0 | 0.0 |

Next, the inventors of the present invention investigated relations between homogeneity of the blended coal and coke strength and clearance in consideration of presence of the pseudo-particles. Discussion of the homogeneity of the blended coal requires taking the brand and the particle diameter of coal in the pseudo-particles contained in the blended coal into consideration. The pseudo-particles formed before the blended coal is prepared is composed of coal of a single brand. By contrast, different brands of coal may be present in the pseudo-particles formed after the preparation and they are mixed to some extent.

Accordingly, in order to examine influence on uniformity of the blended coal and the coke strength by the presence of the pseudo-particles, blended coal needs to be prepared by mixing pseudo-particles composed of coal of a single bland and the strength of coke manufactured from the blended coal needs to be evaluated. It is necessary to make the particle diameter of the single particles or pseudo-particles composing the coal uniform for ideal execution of the evaluation. It is, however, difficult to make the particle diameter of the particles uniform because the coal is non-homogeneous and grinding property is different depending on the texture.

Different types of single coal differing only in moisture contents (moisture content: 3, 4, 6, 8, and 10 [% by mass]) were prepared so as to reproduce coal composed of different particles. Each single coal prepared in accordance with the blending ratio as indicated in Table 1 was put into a drum mixer mainly for convective mixing so as to be mixed while substantially keeping the states of single particles or pseudo-particles composing the coal. Then, the coal was mixed for sixty seconds. It was confirmed that this operation generated little difference in the particle size distribution of the pseudo-particles between before and after the mixing. After the mixing, water was sprayed and added by insufficient moisture content such that the moisture content of the blended coal was 10 [% by mass] and an additional mixing operation was not performed (pseudo-particles are not changed). The blended coal was settled for a day and night.

Figure 2A:
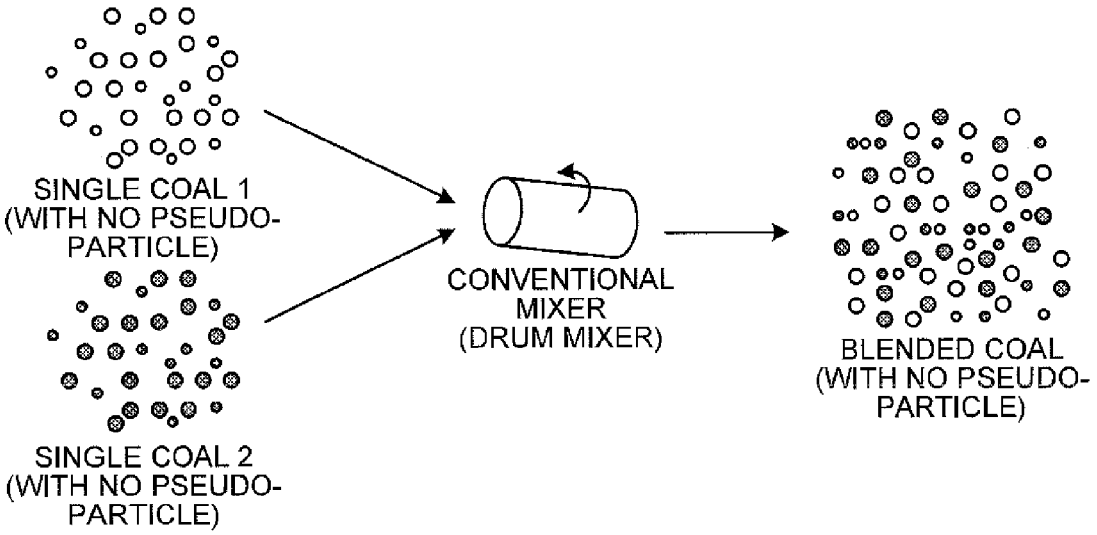
FIG. 2A is a view for explaining homogeneity of blended coal when single coal containing no pseudo-particle are mixed with each other.
Figure 2B:
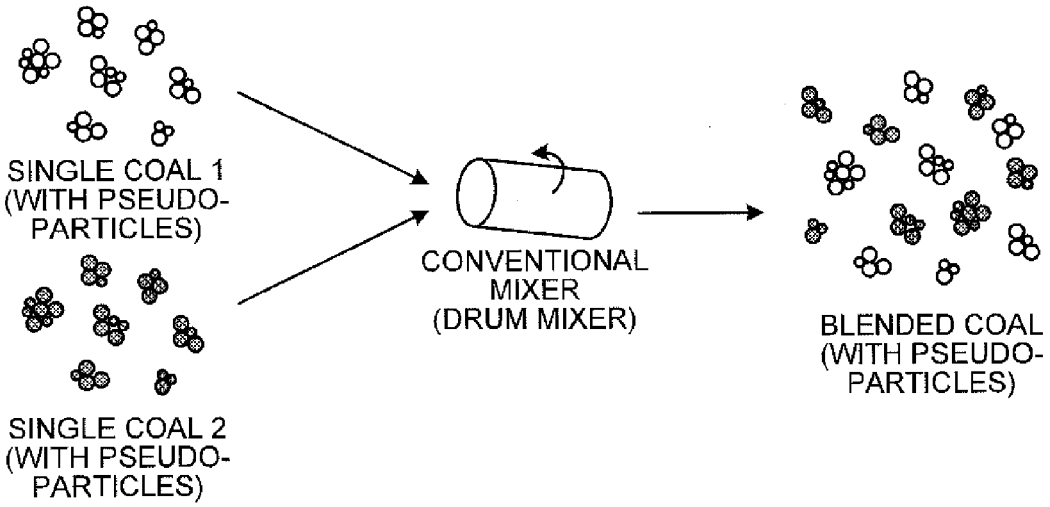
FIG. 2B is a view for explaining homogeneity of blended coal when single coal containing pseudo-particles are mixed with each other.

As illustrated in FIGS. 2A and 2B, the single particles that do not form pseudo-particles or the pseudo-particles are sufficiently mixed in each blended coal prepared by the operation and it can be said that the homogeneity thereof is macroscopically high. The single pseudo-particles are composed of coal of a substantially single brand and quality is largely different among the pseudo-particles. The homogeneity of the blended coal in a range of the size of the pseudo-particles is low.

The coke strength was evaluated in accordance with the following procedures. The blended coal of 17.1 [kg] was charged into a carbonization can so as to have a bulk density (based on a dry weight) of 725 [kg/m$^3$] and was carbonized in an electric furnace at an oven wall temperature of 1050 [° C.] for six hours in a state where a weight of 10 [kg] was placed on the carbonization can. Then, the blended coal was taken out of the furnace and was cooled with nitrogen so as to provide coke. The strength of the provided coke was calculated as follows using the drum strength test method according to JIS K 2151: a mass of coke having a particle diameter of equal to or larger than 15 [mm] after the coke was rotated by 150 times at a rotating speed of 15 [rpm] was measured and a value obtained by multiplying a mass ratio of the measured mass relative to a mass before the rotation by 100 was calculated as a drum index DI (150/15).

Figure 3A:
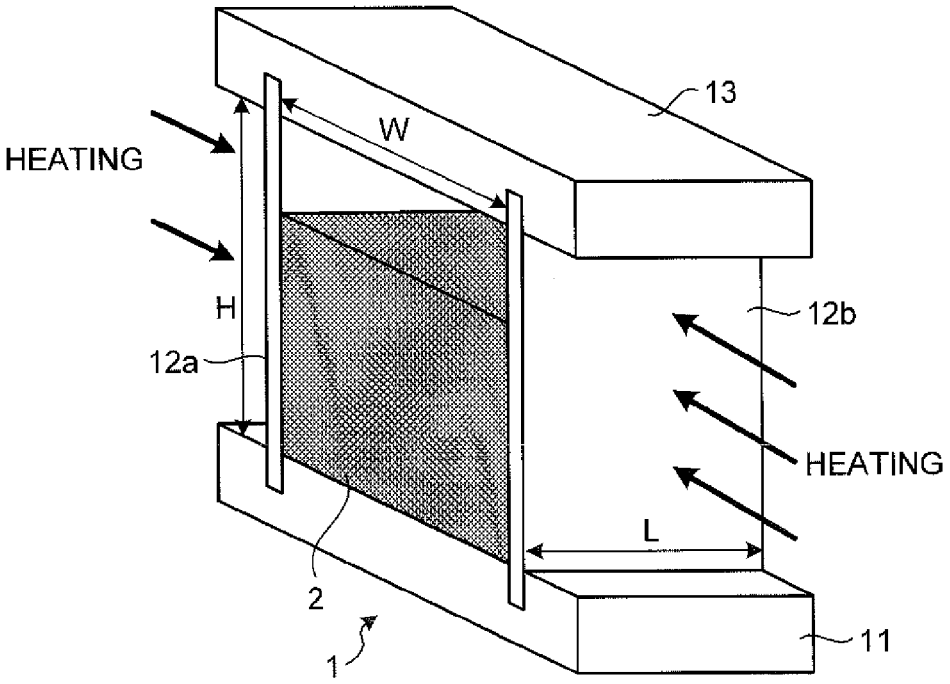
FIG. 3A is a schematic view for explaining an evaluation method of clearance.
Figure 3B:
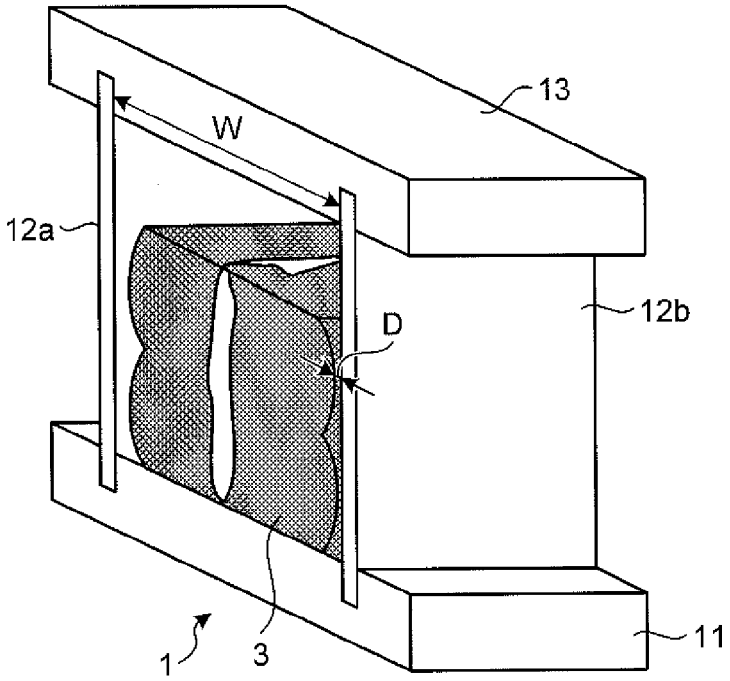
FIG. 3B is a schematic view for explaining the evaluation method of the clearance.

The clearance was evaluated in accordance with the following procedures. The blended coal of 2.244 [kg] was charged into a small-sized simulated retort 1 for measuring the clearance as illustrated in FIGS. 3A and 3B so as to have a bulk density (based on a dry weight) of 775 [kg/m$^3$] and was carbonized in the electric furnace at the oven wall temperature of 1050 [° C.] for four hours and twenty minutes. Then, the blended coal was taken out of the furnace and was cooled with nitrogen so as to provide a cake of coke. A space between one surface of the provided cake of coke and the oven wall was measured by a laser range finder and an average value thereof was calculated. A sum of the average values of the spaces for both the surfaces was defined as the clearance.

The small-sized simulated retort 1 as illustrated in FIGS. 3A and 3B includes a bottom plate 11 formed by bricks, a pair of side plates 12*a* and 12*b* made of metal that are provided to stand on the bottom plate 11, and a top plate 13 formed by bricks arranged on the pair of side plates 12*a* and 12*b*. As illustrated in FIG. 3A, blended coal 2 is charged into a space defined by the plates constituting the small-sized simulated retort 1. As illustrated in FIG. 35, spaces D between a cake of coke 3 provided by carbonization and the pair of side plates 12*a* and 12*b* were measured using the laser range finder. In the embodiment, the small-sized simulated retort 1 has dimensions of length L: 114 [mm]×width W: 190 [mm]×height H: 120 [mm].

Figure 4:
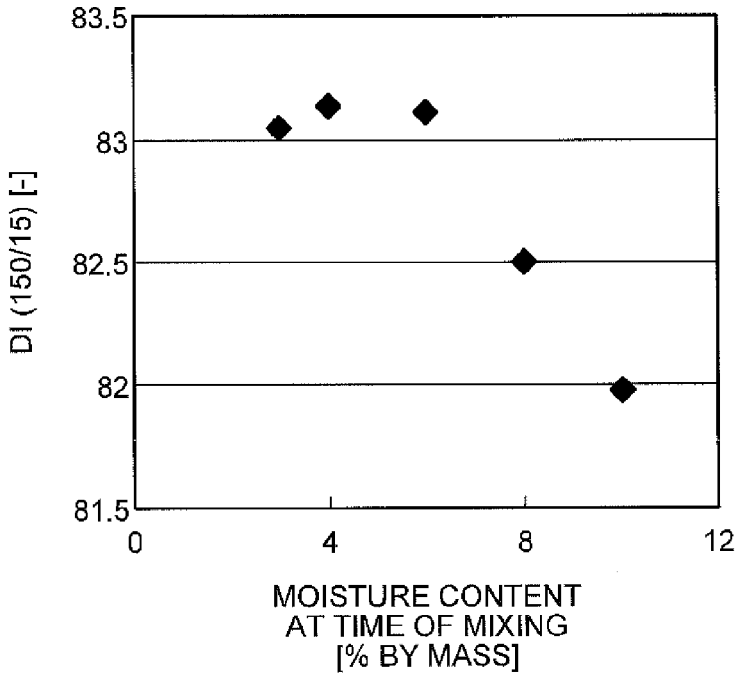
FIG. 4 is a graph illustrating a relationship between the moisture content of single coal used in preparation of blended coal and coke strength.
Figure 5:
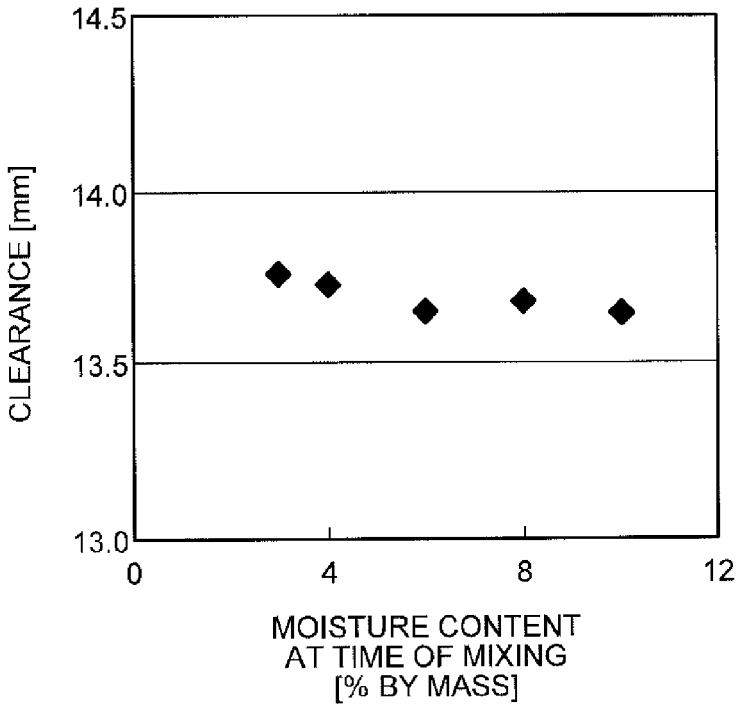
FIG. 5 is a graph illustrating a relationship between the moisture content of the single coal used in the preparation of the blended coal and the clearance.

The following Table 4 indicates measurement results of the coke strength and the clearance. FIG. 4 illustrates a relationship between the moisture content of the single coal used for preparation of the blended coal and the coke strength and FIG. 5 illustrates a relationship between the moisture content of the single coal and the clearance. As illustrated in FIG. 4, the coke strength is hardly changed when the moisture content of the single coal is equal to or lower than 6 [% by mass] but the coke strength is drastically lowered when the moisture content of the single coal is higher than 6 [% by mass].

TABLE 4

| Moisture content at time of mixing [%] | DI (150/15) [—] | Clearance [mm] |
|---|---|---|
| 3 | 83.0 | 13.8 |
| 4 | 83.1 | 13.7 |
| 6 | 83.1 | 13.7 |
| 8 | 82.5 | 13.7 |
| 10 | 82.0 | 13.6 |

Figure 6:
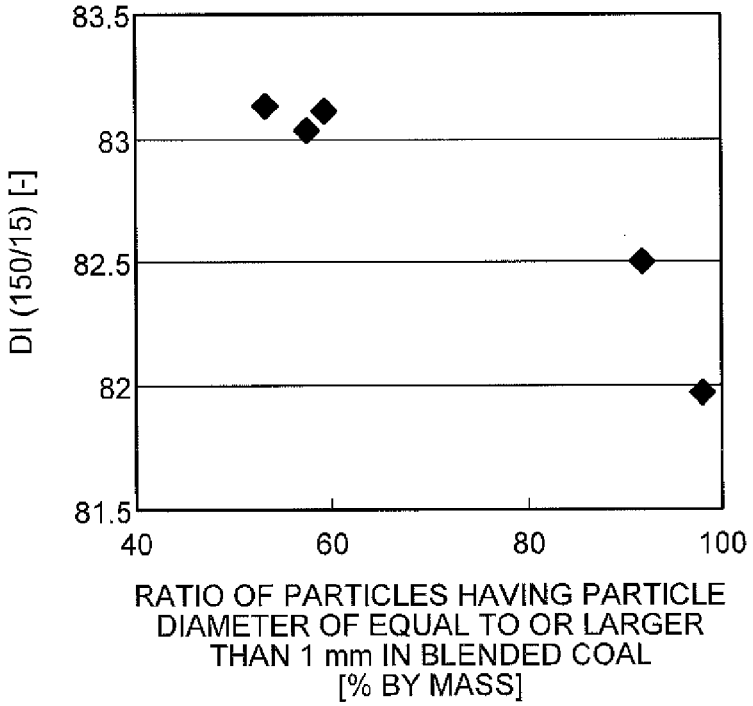
FIG. 6 is a graph illustrating a relationship between a weight ratio of particles having a particle diameter of equal to or larger than 1 [mm] and the coke strength.

In the experiment, the strength of coke manufactured from the blended coal in a state where single coal of a plurality of types blended was not sufficiently mixed in the pseudo-particles was evaluated. FIG. 1 illustrating the relation between the moisture content of the blended coal and the pseudo-particles and FIG. 4 illustrating the relation between the moisture content of the single coal used for preparing the blended coal and the coke strength were compared. As a result, it has been found that a weight ratio of particles having a particle diameter of equal to or larger than 1 [mm] that include the pseudo-particles was significantly increased when the moisture content is equal to or higher than 6 [% by mass] as a critical point of the lowering of the coke strength. To be understood more clearly, FIG. 6 illustrates a relationship between the weight ratio of the particles having the particle diameter of equal to or larger than 1 [mm] in the blended coal as illustrated in FIG. 1 and the coke strength. As illustrated in FIG. 6, a preferable correlation is satisfied between the weight ratio of the particles having a particle diameter of equal to or larger than 1 [mm] in the blended coal and the coke strength.

In view of the above-mentioned situation, it is considered that the homogeneity of the millimeter order (whether an inner portion of a focused solid body each side of which is several millimeters long, for example, is sufficiently mixed) will highly possibly influence the coke strength. By contrast, as illustrated in FIG. 5, the clearance tended to be slightly enlarged with the lowering of the moisture content but was not largely changed. These results can conclude that the breakage of the pseudo-particles the inner portions of which are not sufficiently mixed in the blended coal can improve the coke strength. Furthermore, the size of the clearance does not depend on the state of the pseudo-particles and it is considered that the breakage of the pseudo-particles does not influence discharging property of coke.

The above-mentioned measurement result of the coke strength matches with existing study results provided by investigations on a relation between coke strength and defects. For example, Non-Patent Literature 4 discloses a report indicating that defects having a dimension of the millimeter order cause surface breakage based on an investigation result of the defects causing the surface breakage of coke. Non-Patent Literature 5 discloses a report indicating that a critical point of the size of inert (coal texture that is not softened and molten by heating) causing the lowering of the coke strength is equal to or larger than 1.5 [mm] based on an investigation result of a relation between the size of the inert causing generation of defects and the coke strength.

A reason why the homogeneity of the millimeter order influences the coke strength is considered as follows: when low-grade coal particles like non- or slightly-caking coal having poor melting property in formation of coke agglomerate at the millimeter order, that is, form pseudo-particles, the pseudo-particle portions behave like rough-particle inert and form portions of the millimeter order that do not preferably cake in the coke, in other words, defects having a dimension of the millimeter order.

Figure 7:
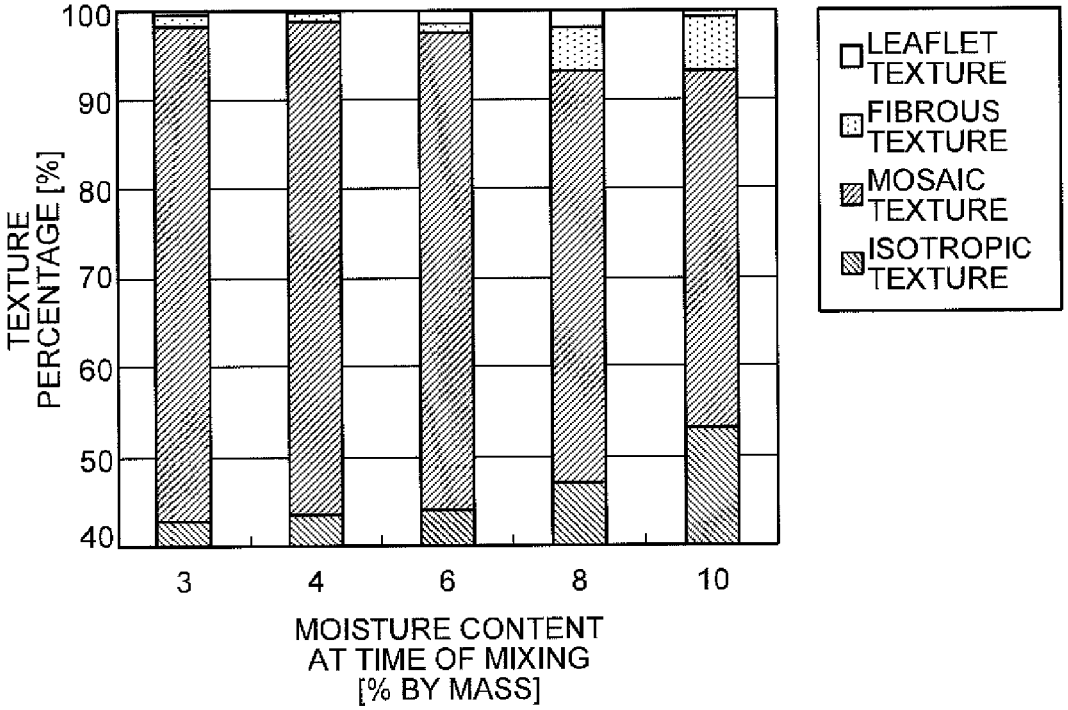
FIG. 7 is a graph illustrating evaluation results of optical textures of coke.

In addition, optical textures of the provided coke ware evaluated. FIG. 7 illustrates evaluation results. As illustrated in FIG. 7, a mosaic texture is developed in blended coal having high homogeneity of the millimeter order that has a moisture content of equal to or lower than 6 [% by mass]. It is said that the optical texture is strongly related with the strength of a coke matrix and the strengths of an isotropic texture and the mosaic texture derived from reactives are high (see Non-Patent Literature 6). Accordingly, it is considered that not only the effect of reduction in the defects having the dimension of the millimeter order but also the effect of development of the mosaic texture contributes to the improvement of the coke strength with homogenization of the blended coal. The mosaic-like texture is developed with the homogenization (mixing enhancement) of the blended coal including inner portions of the pseudo-particles because the mosaic texture formed on a contact interface between coal (a type of coal generally having high coal rank) forming a texture having relatively developed anisotropic property and coal (a type of coal generally having low coal rank) forming an isotropic texture mainly is increased with an increase in the contact interface.

Coke Manufacturing Method

The inventors of the present invention had the idea, based on the above-mentioned investigations and observations, that disintegration of the pseudo-particles by performing an operation of improving the homogeneity of the millimeter order, to be specific, a stirring and mixing operation on the blended coal can prevent the lowering of the coke strength due to the lowering of the homogeneity of the blended coal even when the moisture content of the blended coal is equal to or higher than 6 [% by mass]. Based on this idea, the inventors of the present invention evaluated a stirring and mixing apparatus capable of performing the stirring and mixing operation (shear mixing) for disintegrating and uniformly dispersing pseudo-particles having a particle diameter of equal to or larger than 1 [mm] that are formed when the moisture content is equal to or higher than 6 [% by mass], and mixing performance thereof.

First, the inventors of the present invention earnestly studied and devised an indexing method of: the degree of disintegrating the pseudo-particles having a particle diameter of equal to or larger than 1 [mm]; and the degree of uniform dispersion in the following manner.

(1) Coal to which powder-like fluorescent paint (FX-305 manufactured by SINLOIHI CO., LTD) has been applied is prepared as tracer. The tracer emits light when being irradiated with ultraviolet rays. Accordingly, blended coal to which the tracer has been partially added and on which the stirring and mixing operation has been performed is shot by a digital camera while being irradiated with ultraviolet rays and a formed image is subject to image processing, so that the size and the dispersion state of the tracer in the blended coal can be indexed. The tracer can be easily extracted on an image by setting a threshold of brightness or luminosity appropriate for image data. The inventors of the present invention extracted a tracer portion by setting the threshold of the brightness.

(2) The coal, as the tracer, to which the fluorescent paint has been applied is added to blended coal such that an area percentage of particles having a particle diameter of equal to or larger than 1 [mm], which also include pseudo-particles, is approximately 5[%] (area percentage of fluorescent portions having a particle diameter of equal to or larger than 1 [mm] when outer appearance of the blended coal is shot while being irradiated with ultraviolet rays is approximately 5[%]). As the particle diameter of the coal added as the tracer, an average value of lines each connecting two points of the outer circumference of the extracted tracer portion and passing through the center of gravity of the tracer portion that were measured in increments of 2[°] was employed. The moisture content of the blended coal was adjusted to 10 [% by mass].

(3) The stirring and mixing operation was performed on the blended coal to which the tracer was added and the mixture after the stirring and mixing operation was shot while being irradiated with ultraviolet rays. Then, a formed image was image-processed and an area percentage of particles having a particle diameter of equal to or larger than 1 [mm] was measured. A measured value was put into the following equation (2) so as to calculate a disintegrated level. A parameter A in the equation (2) is the area percentage of the particles having a particle diameter of equal to or larger than 1 [mm] after the stirring and mixing operation and $A_0$ is an initial area percentage (approximately 5[%]) of the particles having a particle diameter of equal to or larger than 1 [mm]. That is to say, as the pseudo-particles are disintegrated by the stirring and mixing operation, the value of the disintegrated level becomes higher.

$$\text{Disintegrated level}=1-A/A_0 \quad (2)$$

The above-mentioned method enables whether the pseudo-particles of the coal to which the fluorescent paint has been applied are disintegrated to be observed directly. This method can evaluate the disintegrated level of the pseudo-particles more accurately than a method of measuring the particle size distribution of the pseudo-particles simply. In general, coal forms the pseudo-particles easily under presence of water, so that the structure of the pseudo-particles can possibly change by handling or sieving after mixing. In view of this nature, the above-mentioned method is employed for evaluation of the disintegrated level.

Subsequently, the inventors of the present invention studied mixing performance of a mixer and employed "Measurement for Mixing Degree of Powders by Optical Method" as an evaluation method reported by the association of powder process industry and engineering (see Non-Patent Literature 7). The following will describe procedures and an evaluation method thereof in detail. In the evaluation method, 5 [% by mass] of dark red rouge (iron(III) oxide, average particle diameter 0.47 [μm]) and 95 [% by mass] of white calcium carbonate (average particle diameter 2.66 [μm]) as common powders are put into a mixer and the stirring and mixing operation is performed on the mixture.

A sample after the stirring and mixing operation is taken out and the brightness of the sample is measured using a photometer (manufactured by MSE CO., LTD.). The sample turns red as the entire color while agglomerates of the rouge are gradually disintegrated and dispersed with advancement of the stirring and mixing operation. Accordingly, the degree of the current brightness relative to the brightness in the case where the agglomerates are totally mixed in a mortar is measured, so that the advancement level of the stirring and mixing operation can be determined. An attainment level thereof can be defined by the following equation (3).

$$\text{Attainment Level}=(V_{max}-V(t))/(V_{max}-V_{st}) \quad (3)$$

In the equation (3), a parameter t indicates an elapsed time from the start of stirring and mixing, $V_{max}$ indicates the brightness of calcium carbonate, $V_{st}$ indicates the brightness of mixture formed by totally mixing calcium carbonate and iron(III) oxide, and V(t) indicates the brightness of the mixture at time t.

With the evaluation method disclosed in Non-Patent Literature 7, the above-mentioned evaluation is performed using various mixers and the mixers are classified into three patterns based on curve shapes formed by the mixing time and the attainment level. With a mixer of a type A mainly for convective mixing, a curve that is downward convex is formed. With a mixer of a type B mainly for shear mixing, a curve that is upward convex is formed. With a mixer of a type C for convective mixing and shear mixing in combination, an intermediate curve of the curve with the mixer of the type A and the curve with the mixer of the type B is formed. The shapes of the curves are provided by the stirring and mixing operation for a long period of time. By the stirring and mixing operation for approximately 60 seconds, the attainment level is low and the attainment level hardly changes with the mixer of the type A, the attainment level is equal to or higher than 0.6 with the mixer of the type B, and an intermediate attainment level thereof is provided with the mixer of the type C.

Figure 8:
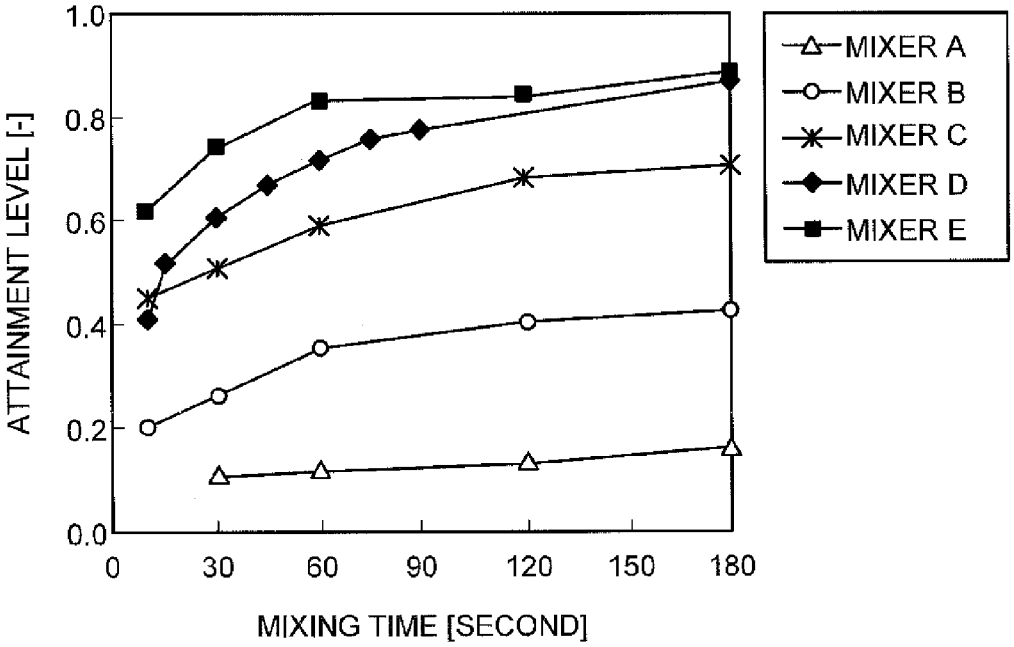
FIG. 8 is a graph illustrating a relationship between stirring and mixing time with a mixer and an attainment level.
Figure 9:
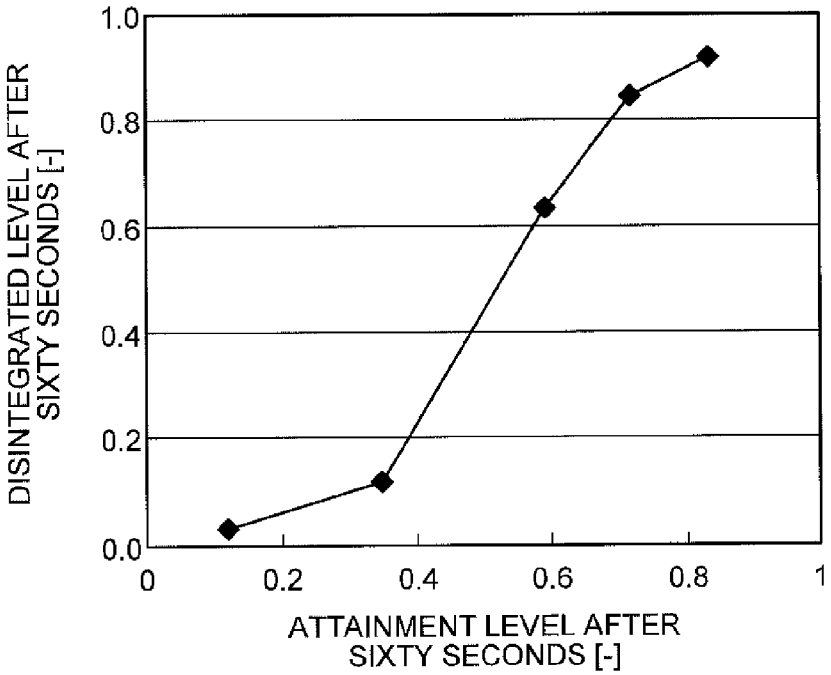
FIG. 9 is a graph illustrating a relationship between an attainment level after 60 seconds and a disintegrated level.

The inventors of the present invention performed the stirring and mixing processing on the blended coal to which the tracer was added for sixty seconds using the mixers of different types and evaluated the disintegrated levels. FIG. 8 illustrates relationships between the stirring and mixing time with the mixers and the attainment levels. A mixer A as illustrated in FIG. 8 is a conventional drum mixer and is classified into the type A. A mixer B is a mixer of the type C and mixers C to E are mixers of the type B. FIG. 9 illustrates a relation between the attainment level and the disintegrated level after sixty seconds.

As illustrated in FIG. 9, the disintegrated level was observed to be largely changed when the attainment level was in a range of 0.4 to 0.6. That is to say, as mixing performance that is necessary for the homogenization of the blended coal of the millimeter order, the attainment level after sixty seconds is equal to or higher than 0.6, and preferably equal to or higher than 0.7. It has been found that a preferable mixer having the mixing performance is the mixer of the type B mainly for shear mixing. As illustrated in FIG. 8, it was observed that the pseudo-particles were hardly disintegrated with the conventional drum mixer-type coal mixer (mixer of the type A) employed in the conventional coke plants.

Thereafter, the inventors of the present invention sorted the mixers mechanically in order to evaluate a relation with the attainment level after sixty seconds. In principle, in order to disintegrate the agglomerates of rouge, force higher than the breakage strength of the agglomerates needs to be applied to the agglomerates. The structures of the mixers are largely different among the types thereof; therefore, action manners of force such as compression force and shear force on the agglomerates are also different among the mixers. For this reason, systematic evaluation of the mixers based on the force that is applied to the agglomerates requires a lot of labor. To solve this problem, the inventors have sorted the mixers by input energy based on the idea that there is a correlation between the force on the agglomerates and the input energy (power) to the mixers.

Figure 10:
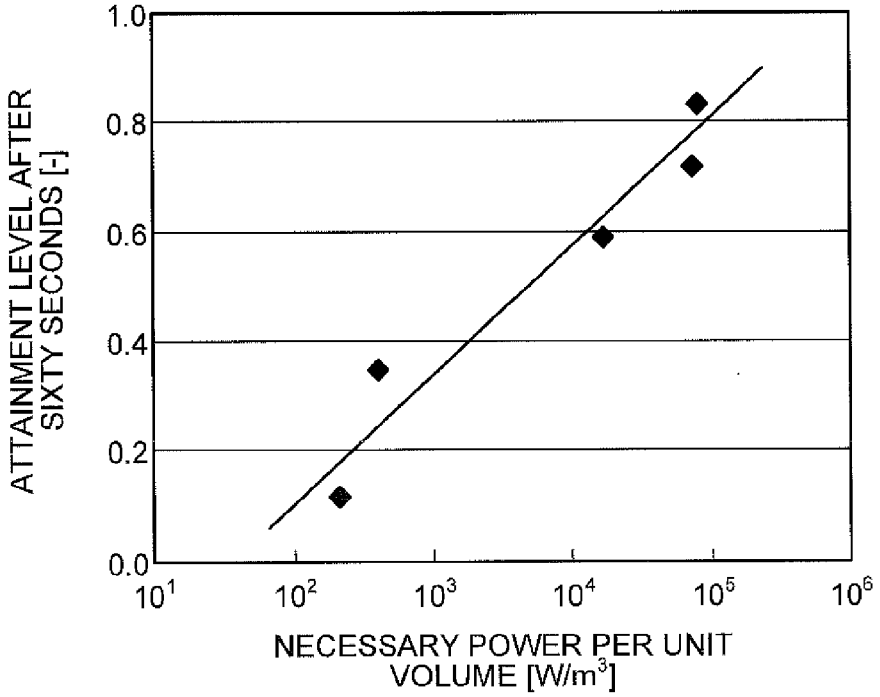
FIG. 10 is a graph illustrating a relationship between necessary power per unit mixing volume and the attainment level after 60 seconds.

Actually, it is considered that the input energy is converted into not only the breakage energy of the agglomerates but also transportation energy of the mixture, friction heat, and the like and individual conversion ratios thereof are different among the mixers. As illustrated in FIG. 10, simple evaluation of the relation between necessary power per unit mixing volume and the attainment level after sixty seconds revealed that a substantially preferable correlation is established. The correlation as illustrated in FIG. 10 indicates that the attainment level after sixty seconds is equal to or higher than 0.6 with a necessary power per unit mixing volume of equal to or higher than $1.0\times10^4$ [W/m$^3$] and the attainment level after sixty seconds is equal to or higher than 0.7 with a necessary power per unit mixing volume of equal to or higher than $3.0\times10^4$ [W/m$^3$].

Accordingly, a preferable mixer having stirring and mixing performance necessary for the homogenization of the blended coal of the millimeter order by the disintegration of the pseudo-particles requires a power per unit mixing volume of equal to or higher than $1.0\times10^4$ [W/m$^3$], and preferably equal to or higher than $3.0\times10^4$ [W/m$^3$]. That is to say, the preferable mixer can be selected easily based on the necessary power and the unit mixing volume without measuring the attainment level.

The above-mentioned examination results showed that introduction of the mixer of the type B into the coke manufacturing line could prevent the lowering of the coke strength due to the lowering of the homogeneity of the blended coal. The mixer includes a batch-type mixer and a continuous-type mixer that are used depending on a processing method. When the batch-type mixer is used, processing time corresponds to mixing time, and the stirring and mixing performance is measured based on the relation between the processing time and the attainment level. By contrast, when the continuous-type mixer is used, residence time in the mixer corresponds to the stirring and mixing time. In this case, it is sufficient that the stirring and mixing performance is measured based on the relation between the residence time and the attainment level and the preferable mixer is selected. It is obvious that the preferable mixer may be selected based on the necessary power per unit mixing volume. Manufacturing of coke requires processing on a huge amount of coal as much as equal to or larger than several hundred [t/h], and the continuous type having high processing capability is more preferable as processing method of the mixer to be introduced into the coke manufacturing line.

The homogeneity of the blended coal after the stirring and mixing processing with the mixer is also influenced by the homogeneity before the stirring and mixing processing with the mixer. That is to say, when the homogeneity before the stirring and mixing processing with the mixer is high, stirring and mixing time that is taken to provide target homogeneity can be reduced and it is efficient. In general, the coke manufacturing line includes a grinding process, a mixing process, and a drying (including partially drying) process and the blended coal is mixed during the pieces of processing in the respective processes and transportation so as to be homogeneous. Accordingly, the stirring and mixing processing with the mixer is desirably performed immediately before the charging into the coke oven as close to the time of charging as possible because it is efficient.

There are several patterns of the order of the processes of processing on the blended coal. Examples of such patterns include the order of the grinding process, the blending process, and the drying process, and the order of the blending process, the grinding process, and the drying process. In any of the patterns, the stirring and mixing processing with the mixer is required to be performed at least after the blending process. A pattern in which the grinding process is performed after the blending process causes the homogeneity of the blended coal to be finally higher than that in the case of a pattern in which the grinding process is performed before the blending process because the blended coal is mixed in the grinding process.

Accordingly, the introduction of the stirring and mixing processing with the mixer into the coke manufacturing line employing the pattern in which the grinding process is performed before the blending process increases an improvement effect in the homogeneity of the blended coal and is particularly effective. Furthermore, the effect of the stirring and mixing is effective when the moisture content of the blended coal is equal to or higher than 6 [% by mass] based on the investigation result of the relation between the moisture content at the time of mixing and the coke strength. Accordingly, even a coke manufacturing line including the process of drying the blended coal can provide an improvement effect in the coke strength by the stirring and mixing processing with the mixer as long as the moisture content of the blended coal after dried is equal to or higher than 6 [% by mass]. Moisture of coal is not required to be evaporated completely in the drying process and the drying process includes a partially drying operation and a moisture control operation for reducing the moisture content. The blended coal may contain additives such as a caking additive, oil, coke fines, petroleum coke, resins, and wastes.

EXAMPLE

In the example, different types of single coal of four types (moisture content 3, 4, 6, 8, and 10 [% by mass]) as indicated in Table 1 differing only in moisture contents were prepared. Then, the single coal of the four types each prepared in accordance with the blending ratio as indicated in Table 1 was stirred and mixed for sixty seconds using mixers A to E of different stirring and mixing modes, whereby blended coal was prepared. Each blended coal prepared was carbonized under the above-mentioned conditions. The drum index DI (150/15) of each coke manufactured and the clearance therefor were measured. The mixer A is a conventional-type drum mixer (Comparison Example 1), the mixers C to E are mixers of the type B mainly for shear mixing (invention examples 1 to 3), and the mixer B is a mixer of the type C having intermediate mixing performance between that of the conventional-type mixer and that of the present invention examples (Comparison Example 2).

Figure 11:
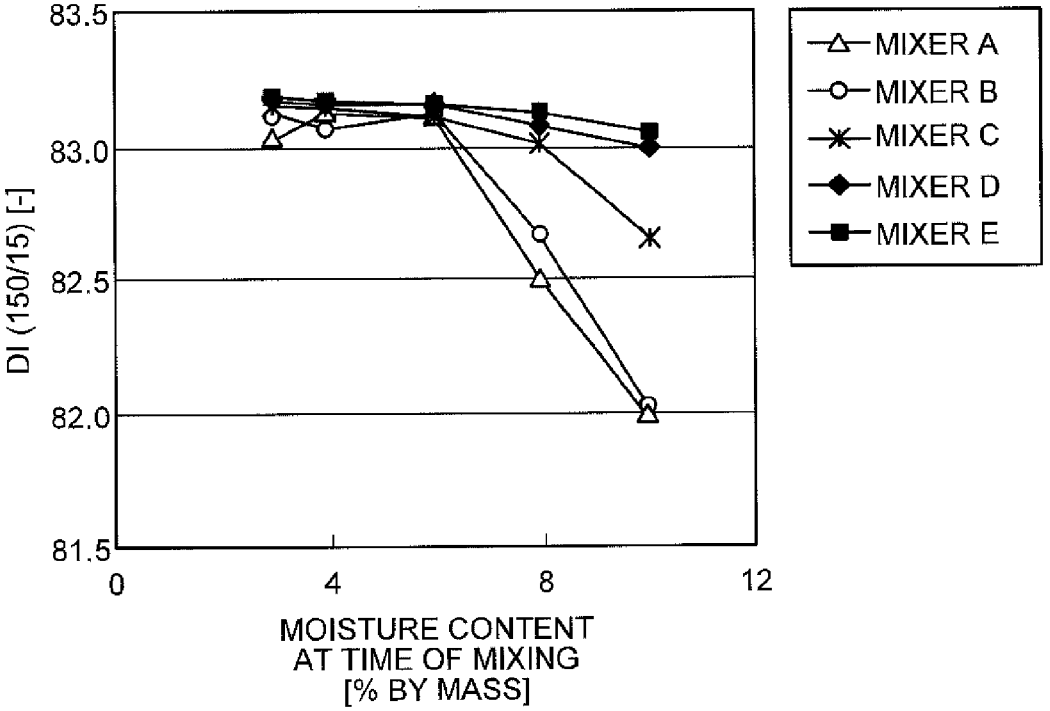
FIG. 11 is a graph illustrating a relationship between the moisture content of blended coal at the time of mixing and drum index of coke.

The following Table 5 indicates measurement results thereof. FIG. 11 illustrates a relation between the moisture content of the blended coal at the time of mixing and the coke drum index DI (150/15). As illustrated in Table 5 and FIG. 11, the strength of the coke manufactured from the blended coal having a moisture content of equal to or higher than 6 [% by mass] at the time of mixing was observed to be improved by the mixing with the mixer. The improvement effect in the coke strength was largely changed depending on the type of the mixer. That is to say, the improvement effect in the coke strength was large with the mixer of the type B and the strength of coke manufactured from even blended coal having a moisture content of 10 [% by mass] at the time of mixing was recovered as high as the strength of coke manufactured from the blended coal having a moisture content of equal to or lower than 6 [% by mass]. By contrast, less improvement effect in the coke strength was observed when the mixer of the type A or the type C was used. Little difference in the clearance was observed with any of the mixing operations. Coke strength after $CO_2$ reaction (CSR) (measured in accordance with ISO18894) of the manufactured coke indicated tendency similar to the drum index DI (150/15). That is to say, under the conditions of the Comparison Example 1, the CSR was 59.2[%], 59.0[%], and 57.5 [%] when the moisture content at the time of mixing was 4, 6, and 8 [% by mass], respectively, and the strength tended to be lowered with an increase in the moisture content. Under the conditions of the present invention example 3, the CSR was 59.8[%], 59.7[%], and 59.4[%] when the moisture content at the time of mixing was 4, 6, and 8 [% by mass], respectively, and the lowering of the strength was hardly observed.

TABLE 5

| Moisture content | Mixer A (Comparison Example 1) | | Mixer B (Comparison Example 2) | | Mixer C (Invention Example 1) | | Mixer D (Invention Example 2) | | Mixer E (Invention Example 3) | |
|---|---|---|---|---|---|---|---|---|---|---|
| at the time of mixing [%] | DI (150/15) [—] | Clearance [mm] | DI (150/15) [—] | Clearance [mm] | DI (150/15) [—] | Clearance [mm] | DI (150/15) [—] | Clearance [mm] | DI (150/15) [—] | Clearance [mm] |
| 3 | 83.0 | 13.8 | 83.1 | 13.8 | 83.2 | 13.8 | 83.2 | 13.8 | 83.2 | 13.8 |
| 4 | 83.1 | 13.7 | 83.1 | 13.8 | 83.2 | 13.8 | 83.2 | 13.8 | 83.2 | 13.8 |
| 6 | 83.1 | 13.7 | 83.1 | 13.7 | 83.1 | 13.8 | 83.2 | 13.8 | 83.2 | 13.8 |
| 8 | 82.5 | 13.7 | 82.7 | 13.7 | 83.0 | 13.7 | 83.1 | 13.7 | 83.1 | 13.8 |
| 10 | 82.0 | 13.6 | 82.0 | 13.7 | 82.7 | 13.7 | 83.0 | 13.7 | 83.1 | 13.8 |

As illustrated in FIG. 1, the pseudo-particles having the particle diameters of equal to or larger than 1 [mm] are formed from the blended coal having a moisture content of equal to or higher than 6 [% by mass]. As indicated in Table 5, the coke strength is improved by mixing the blended coal having a moisture content of equal to or higher than 6 [% by mass] with the mixer of the type B as the present invention examples under the conditions in which the disintegrated level becomes high and the coke strength becomes equivalent to the coke strength when the blended coal having a moisture content of equal to or lower than 4 [% by mass] that form substantially no pseudo-particle is used. From the above-mentioned results, the improvement effect in the coke strength according to the present invention can be considered to be provided by the disintegration of the pseudo-particles contained in the blended coal by the mixing operation with the mixer.

Furthermore, when the mixers D and E as illustrated in FIG. 11 were used, the strength of coke manufactured from even the blended coal having high moisture content was recovered as high as the strength of coke manufactured from the blended coal having a moisture content of equal to or lower than 4 [% by mass]. Based on this result, it can be considered that the pseudo-particles present in the blended coal were disintegrated substantially completely. Improvement in the coke strength to some extent in comparison with that in the case using the mixer A is observed in some cases as in the case where the blended coal having a moisture content of 10 [% by mass] was mixed using the mixer C as illustrated in FIG. 11. A part of the pseudo-particles can be disintegrated with the mixer C and the coke strength can be improved by disintegrating a part of the pseudo-particles.

The above-mentioned investigations revealed that even the blended coal having a moisture content of equal to or higher than 6 [% by mass] and low homogeneity of the millimeter order can prevent the lowering of the coke strength due to the lowering of the homogeneity of the blended coal, which cannot be prevented with a conventional mixer, by performing the stirring and mixing processing using the mixer of the type B mainly for shear mixing. In addition, the clearance can be kept by the stirring and mixing operation. This can result in effectiveness of the present invention as a unit for improving the coke strength by the wet coal operation in an old coke oven.

The examples clarify that the improvement effect in the coke strength is observed by stirring and mixing the blended coal for sixty seconds using the mixer C, D, or E. The stirring and mixing may be performed for equal to or more than sixty seconds because the attainment level is improved with an increase in the stirring and mixing time. As illustrated in FIG. 8, the attainment level after the stirring and mixing for sixty seconds is equal to or higher than 0.6 (the attainment level after the stirring and mixing with the mixer C for sixty seconds=0.6). It is, therefore, preferable for improvement in the coke strength that the blended coal having a moisture content of equal to or higher than 6 [% by mass] be stirred and mixed under conditions in which the attainment level becomes equal to or higher than 0.6.

As illustrated in FIG. 9, the disintegrated level of the pseudo-particles after the stirring and mixing for sixty seconds is equal to or higher than 0.6 (disintegrated level after the stirring and mixing with the mixer C for sixty seconds=0.62). It is, therefore, preferable for improvement of the coke strength that the pseudo-particles be disintegrated by stirring and mixing the blended coal so as to make the disintegrated level of the pseudo-particles having a particle diameter of equal to or larger than 1 [mm] in the blended coal to be equal to or higher than 0.6.

As illustrated in FIG. 8, with use of the mixer with which the attainment level after the stirring and mixing for sixty seconds is equal to or higher than 0.6, the attainment level is equal to or higher than 0.4 even when the stirring and mixing time is ten seconds and the partial disintegration of the pseudo-particles is expected to improve the coke strength. With use of the mixer (for example, mixer E) with which a high attainment level can be provided, the attainment level is equal to or higher than 0.6 when the stirring and mixing time is ten seconds. It is, therefore, preferable that the blended coal be stirred and mixed for equal to or more than ten seconds with the mixer with which the attainment level after the stirring and mixing for sixty seconds is equal to or higher than 0.6.

Another Comparison Example

In the above-mentioned example, it has been observed that when the moisture content is high, insufficient disintegration of the pseudo-particles causes the coke strength to be lowered. In this comparison example, a test was executed using the mixer A while the moisture content was changed in order to examine influence on the coke strength by the moisture content. The conditions other than the moisture content were set to be the same as those in the example 1. The following Table 6 indicates a test result thereof. As indicated in Table 6, when the moisture content is equal to or higher than 6.0 [% by mass], the coke strength is lowered. By contrast, in the above-mentioned examples, even when the moisture content is equal to or higher than 8 [% by mass], the coke strength is hardly lowered. For this reason, the effect of the present invention is significantly provided under the condition in which the moisture content is equal to or higher than 6 [% by mass].

TABLE 6

| Moisture content [% by mass] | DI (150/15) [—] |
|---|---|
| 5.8 | 83.12 |
| 6.0 | 83.08 |
| 6.2 | 83.02 |
| 6.5 | 82.95 |

The embodiment to which the present invention made by the inventors is applied has been described above. The present invention is not limited by the description and the drawings configuring a part of disclosure of the present invention. That is to say, other embodiments, examples, operation techniques, and the like based on the embodiment that can be made by those skilled in the art are encompassed in a range of the present invention.

REFERENCE SIGNS LIST

1 SMALL-SIZED SIMULATED RETORT
2 BLENDED COAL
3 CAKE OF COKE
11 BOTTOM PLATE
12*a*, 12*b* SIDE PLATE
13 TOP PLATE

The invention claimed is:

1. A coke manufacturing method comprising:

preparing blended coal by blending coal of at least two types;

stirring and mixing the blended coal to disintegrate at least a part of pseudo-particles in the blended coal that have been formed by agglomeration of coal particles; and charging the blended coal after stirring and mixing into a coke oven and carbonizing the blended coal to manufacture coke, wherein the stirring and mixing is performed on blended coal having a moisture content of not less than 6% by mass.

2. The coke manufacturing method according to claim 1, wherein the preparing comprises drying the coal of at least two types.

3. The coke manufacturing method according to claim 1, wherein the preparing comprises grinding the coal of at least two types before blending the coal of at least two types.

4. A coke manufacturing method comprising:

preparing blended coal by blending coal of at least two types:

stirring and mixing the blended coal to disintegrate at least a part of pseudo-particles in the blended coal that have been formed by agglomeration of coal particles; and charging the blended coal after stirring and mixing into a coke oven and carbonizing the blended coal to manufacture coke, wherein the stirring and mixing comprises stirring and mixing the blended coal using a mixing device having stirring and mixing performance with which an attainment level calculated from the following equation (1) becomes not less than 0.6 after sixty seconds has passed from start of a stirring and mixing operation:

$$\text{Attainment Level}=(V_{max}-V(t))/(V_{max}-V_{st}) \quad (1)$$

where the attainment level is a value calculated from brightness of mixture formed by putting 95% by mass of calcium carbonate having an average particle diameter of 2.66 μm and 5% by mass of iron(III) oxide having an average particle diameter of 0.47 μm into the mixing device and performing the stirring and mixing operation, t indicates an elapsed time from the start of the stirring and mixing operation, $V_{max}$ indicates brightness of calcium carbonate, $V_{st}$ indicates brightness of the mixture in which calcium carbonate and iron(III) oxide are totally mixed, and V(t) indicates brightness of the mixture at time t in the equation (1).

5. A coke manufacturing method comprising:

preparing blended coal by blending coal of at least two types;

stirring and mixing the blended coal to disintegrate at least a part of pseudo-particles in the blended coal that have been formed by agglomeration of coal particles; and charging the blended coal after stirring and mixing into a coke oven and carbonizing the blended coal to manufacture coke, wherein the stirring and mixing comprises stirring and mixing the blended coal using a mixing device that requires power per unit mixing volume of not less than $1.0\times10^4$ W/m$^3$.

6. The coke manufacturing method according to claim 4, wherein the preparing comprises grinding the coal of at least two types before blending the coal of at least two types.

7. The coke manufacturing method according to claim 4, wherein the preparing comprises drying the coal of at least two types.

8. The coke manufacturing method according to claim 5, wherein the preparing comprises grinding the coal of at least two types before blending the coal of at least two types.

9. The coke manufacturing method according to claim 5, wherein the preparing comprises drying the coal of at least two types.

* * * * *